US008163988B2

(12) United States Patent
Holl et al.

(10) Patent No.: US 8,163,988 B2
(45) Date of Patent: Apr. 24, 2012

(54) SNARE TENSION DEVICE

(75) Inventors: Winfried Holl, Illertissen-Au (DE); Ruben Steinhauser, Altusried (DE)

(73) Assignee: Gewa Music GmbH, Adorf (DE)

( * ) Notice: Subject to any disclaimer, the term of this patent is extended or adjusted under 35 U.S.C. 154(b) by 0 days.

(21) Appl. No.: 12/729,635

(22) Filed: Mar. 23, 2010

(65) Prior Publication Data

US 2010/0313733 A1 Dec. 16, 2010

(30) Foreign Application Priority Data

Jun. 15, 2009 (DE) ..... 10 2009 024 908

(51) Int. Cl.
*G10D 13/02* (2006.01)

(52) U.S. Cl. ..... 84/415

(58) Field of Classification Search ..... 84/415
See application file for complete search history.

(56) References Cited

U.S. PATENT DOCUMENTS

| | | | | |
|---|---|---|---|---|
| 4,203,343 | A | 5/1980 | Bargeman | |
| 5,557,053 | A | 9/1996 | Nickel | |
| 5,684,257 | A | 11/1997 | Yanagisawa | |
| 6,008,445 | A * | 12/1999 | Chen | 84/415 |
| 6,573,442 | B1 * | 6/2003 | Lombardi | 84/415 |
| 6,846,978 | B2 * | 1/2005 | Dorfman et al. | 84/415 |
| 6,891,098 | B1 * | 5/2005 | Lombardi | 84/415 |
| 7,220,905 | B2 * | 5/2007 | Takegawa | 84/415 |
| 7,262,355 | B2 * | 8/2007 | Hagiwara et al. | 84/415 |
| 7,745,712 | B2 * | 6/2010 | Dunnett | 84/415 |
| 2006/0266198 | A1 | 11/2006 | Jeffries et al. | |
| 2010/0242707 | A1 * | 9/2010 | Miyajima | 84/415 |
| 2010/0313733 | A1 * | 12/2010 | Holl et al. | 84/415 |

* cited by examiner

*Primary Examiner* — Elvin G Enad
*Assistant Examiner* — Robert W Horn
(74) *Attorney, Agent, or Firm* — Butzel Long

(57) ABSTRACT

The invention relates to a snare tension device for tensioning and releasing a snare wire. In the snare tension device a rotation movement of a rotation element is transferred to a pushing element by means of a transfer element.

20 Claims, 5 Drawing Sheets

SNARE TENSION DEVICE

CROSS-REFERENCE TO RELATED APPLICATIONS

This application is related to and claims the benefit of priority from, German Patent Application Serial Number 10 2009 024908.7, filed 15 Jun. 2009, the disclosure of which is incorporated by reference in its entirety.

FIELD OF INVENTION

The invention relates to a snare tension device for tensioning and releasing a snare wire at a snare.

BACKGROUND OF INVENTION

Snare tension devices for tensioning and releasing a snare wire are already known from the prior art. U.S. Pat. No. 7,220,905 B2 discloses a snare tension device for tensioning and releasing the snare wire at a resonance skin of a snare. Specifically the tensioning and releasing of the snare wire is carried out by means of a lever which is rotatable around a fulcrum. The lever comprises a projection in a section spaced apart from the fulcrum, which projection is guided in a groove of a pushing element, in an range distant to the fulcrum. The projection is arranged with respect to the fulcrum of the lever so that the rotation movement of the lever is transferred to a translatoric movement of the pushing element within a guiding range when the lever is rotated.

A fixing device for fixing the snare wire is provided at one end of the pushing element. The translatoric movement of the pushing element is transferred to the snare wire by means of said fixing device which causes a tensioning or releasing of the snare wire. In addition, the snare tension housing comprises a locking device preventing an automatic releasing of the snare wire from a tensioned position.

The known snare tension device comprises several disadvantages by providing the groove in the pushing element in which groove the projection of the lever is guided. There is a disadvantage that dirt can accumulate within the groove so that a movement of the projection or rather the lever is hindered within the groove. Additionally, when the snare tension device is damaged, there is a disadvantage that components of the snare tension device can project into the groove and, thus, can totally block a movement of the projection or rather the lever. Likewise, a slight tilting of the pushing element from the direction parallel to the guide range can result in jamming the movement of the pushing element towards the guide direction.

SUMMARY OF THE INVENTION

The object of the present invention is to provide an alternative snare tension device in which a rotation movement of a rotation unit can be easily transferred to a translatoric movement of the pushing element without the risk of jamming the rotation unit.

Said object is solved by the features of patent claim 1 according to the invention. Advantageous embodiments of the invention are subject-matter of the dependent claims.

In particular, the advantages achieved by the invention are that a transfer element for transferring the rotation movement of a rotation unit to a translatoric movement of a pushing element is provided as a separate component in a transfer unit. The transfer element is connected with both the rotation unit and the pushing element. Thus, the provision of a groove in the pushing element in the embodiment according to the invention is relinquished. Therefore, it is secured that no components of the snare tension device project into a groove and, thus, could block the rotation movement of the rotation unit. In addition, it is secured that no dirt hindering the rotation movement of the rotation unit can accumulate within the groove.

A further advantageous embodiment of the invention is that the rotation unit is rotated in a predetermined position in which a tensile force, which is applied by the snare wire, causes a torque on the rotation unit in order to tension the snare wire. Said torque is directed towards the same direction as a rotation direction of the rotation unit which causes a tension of the snare wire.

Such a structure comprises the advantage that there is no risk anymore that the snare wire can automatically and unintentionally loose and release again by means of the tensile force which is exerted to the rotation unit by the snare wire. Thus, in a tensioned state of the snare tension device, there is no necessity to provide a locking device for the rotation unit, which locking device prevents an unintentional reverse movement of the rotation unit into a released position. In the end, an omission of the locking device results in a reduction of the manufacturing costs of the snare tension device. Additionally, the handling of the snare tension device is simplified for the user because the user does not need to operate a locking device.

In addition, there is a further advantageous embodiment of the invention that the usage of a rotating wheel as a rotation element of the rotation unit does not comprise the risk that the rotating wheel can be bend or otherwise damaged as it is the case when a lever is used as a rotation element. Additionally, there is an advantage in the usage of a rotating wheel as a rotation element that the rotating wheel can be easily operated by lefthanders as well as by right-handers.

A further advantageous embodiment of the invention is to provide ball bearings, which prevent a force transfer from the rotation element to the bolt, between the rotation element and a bolt. It is secured by means of said ball bearings that the rotation element runs very smooth.

Additionally, there is a further advantageous embodiment of the invention in that a fine adjustment of the tension acting on the snare wire can be conducted by means of an adjustment device.

BRIEF DESCRIPTION OF THE DRAWINGS

Details of the invention will be described by means of the drawings in detail. There is.

WRITTEN DESCRIPTION

Figure 1:
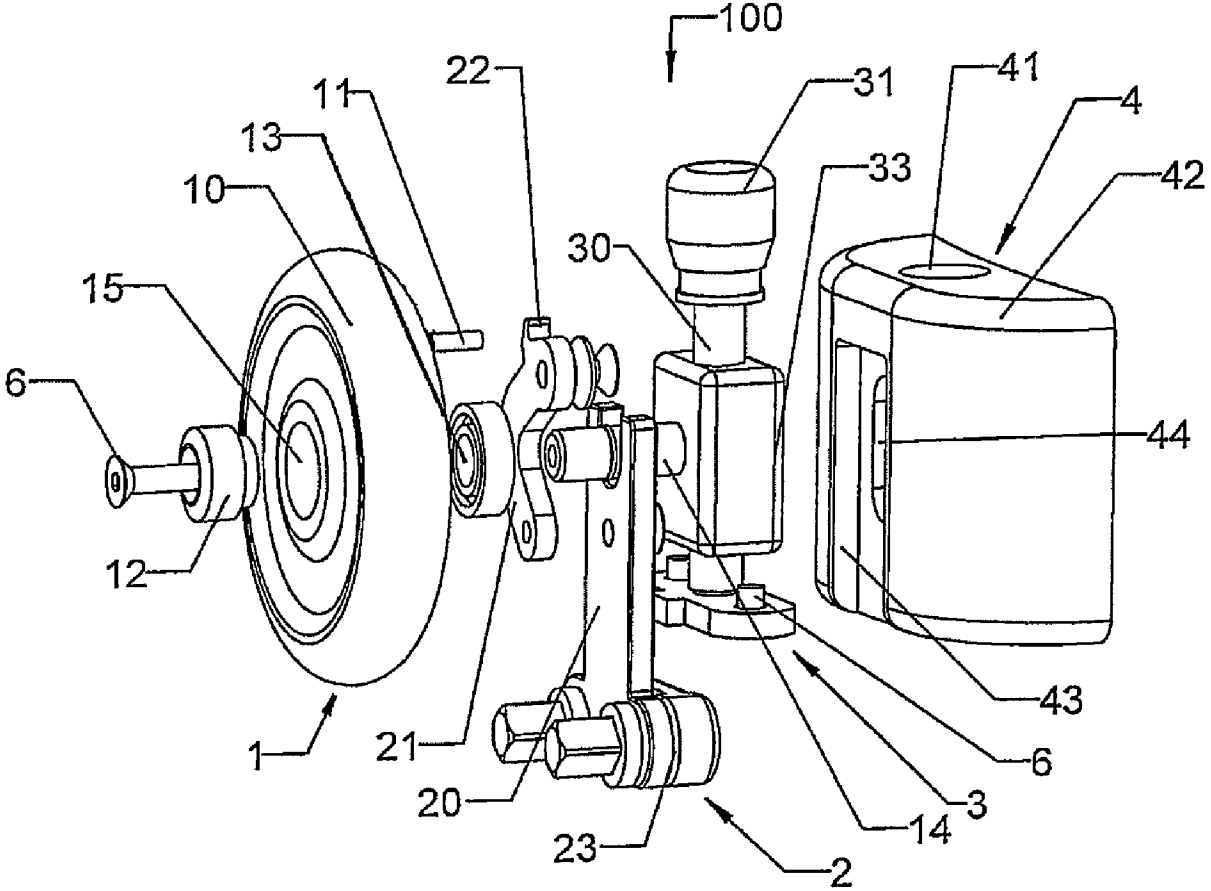
FIG. 1 an explosion view of the separate components of the snare tension device, FIG. 2 a perspective view of the snare tension device without a snare tension housing, FIG. 3 a perspective view of the snare tension device with a snare tension housing, FIG. 4 a perspective view of the snare tension device without a snare tension housing and an adjustment device in a state in which no tension is exerted on the snare wire, FIG. 5 a perspective view of the snare tension device without a snare tension housing and an adjustment device in a state in which a tension is exerted on the snare wire, FIG. 6 a perspective view of the snare tension device without a snare tension housing and an adjustment device in a state in which a maximum tension is exerted on the snare wire and in which the snare tension device is in a locked state.

The snare tension device 100 shown in FIG. 1 comprises a rotation unit 1, a transfer unit 2, an adjustment device 3 and a snare tension housing 4.

The rotation unit 1 comprises a rotation element 10 that is e.g. formed as a rotating wheel in the present embodiment. The rotation element 10 comprises an aperture 15 at its center in which a ball bearing 13 and a sleeve 12 are insertable. The sleeve 12 comprises two portions with different outer diameters. The first portion distant to the transfer unit 2 has an outer diameter, which corresponds with the inner diameter of the aperture 15 of the rotation element 10. The second portion of the sleeve 12 facing to the transfer unit 2 has a diameter corresponding with an inner diameter of an aperture arranged in the ball bearing 13. Additionally, the sleeve 12 comprises an aperture in which a fixing means 6 can be inserted. Here, for example, the fixing means 6 is a screw. Furthermore, the rotation unit 1 comprises a pin 11, which is shown in an assembled state in FIG. 2, on a side of the rotation element 10 facing to the transfer unit 2.

The transfer unit 2 comprises a transfer element 21 in the form of a curved or angular lever, a pushing element 20 and a fixing device 23. The transfer element 21 is connected at its one end with the rotation element 10 and at its other end with the pushing element 20. The transfer element 21 comprises a projection 22 on its end connected with the rotation element 10 and is formed as a curved eccentric lever which surrounds a part of the bolt 14.

The bolt 14 is fixedly connected with the adjustment device 3 at its one end. At the end of the bolt 14 distant to the adjustment device 3, the bolt comprises a hole. In said hole the fixing element 6 is screwed in so that the sleeve 12 and, thus, the rotation unit 1 is connected with the bolt 14.

The pushing element 20 is basically formed as a flat rectangular stripe and comprises the fixing device 23, which is connected with the snare wire not shown, at its end directed downwards in FIG. 1. The pushing element 20 comprises a u-shaped relief through which the bolt 14 is guided at the end distant to the fixing device 23. Specifically, the u-shaped relief comprises two limbs which are spaced apart from each other by the relief.

The adjustment device 3 consists of an adjustment means 31, an adjustment shaft 30 and an adjustment body 33. The bolt 14 is fixedly connected with the adjustment body 33 at the end of the bolt 14 distant to the rotation unit 1. The adjustment body 33 can be moved relative to the adjustment shaft 30 by a rotation of the adjustment means 31. In one embodiment, a relative movement of the adjustment body 33 with respect to the adjustment shaft 30 can be conducted analogue to a relative movement of a spindle nut with respect to a spindle wherein the adjustment body 33 corresponds with the spindle nut and the adjustment shaft 30 corresponds with the spindle. In such an embodiment the adjustment body 33 comprises a hole, which has an inner thread, and the adjustment shaft 30 comprises an outer thread wherein the adjustment shaft 30 is screwed through the hole of the adjustment body 33. Additionally, the adjustment device 3 comprises fixing means 6, which can be used to fix the adjustment device 3 in the snare tension housing 4, at the end of the adjustment shaft 30 distant to the adjustment means 31. For example the fixing means 6 are screws.

The snare tension housing 4 comprises a housing 42 that consists of a face having a form corresponding with the snare peripheral area and directed to the snare, a face directed to the adjustment device 3 and two end faces. The housing 42 comprises an aperture 41 at its one end face (in FIG. 1 the top) and a relief 43 in form of a groove for guiding the pushing element 20 at the face directed to the adjustment device 3. In an assembled state of the snare tension housing the adjustment body 33 of the adjustment device 3 is accommodated in the inside of the snare tension housing 4 (not shown). Furthermore, in the relief 43, the snare tension housing 4 comprises an elongated hole 44 with the bolt 14 passed therethrough. The elongated hole 44 is constructed so that the up and down movement of the bolt connected with the adjustment body 33 is not hindered by the snare tension housing 4 when the tension acting on the snare wire is finely adjusted by means of the adjustment device 3.

Figure 2:
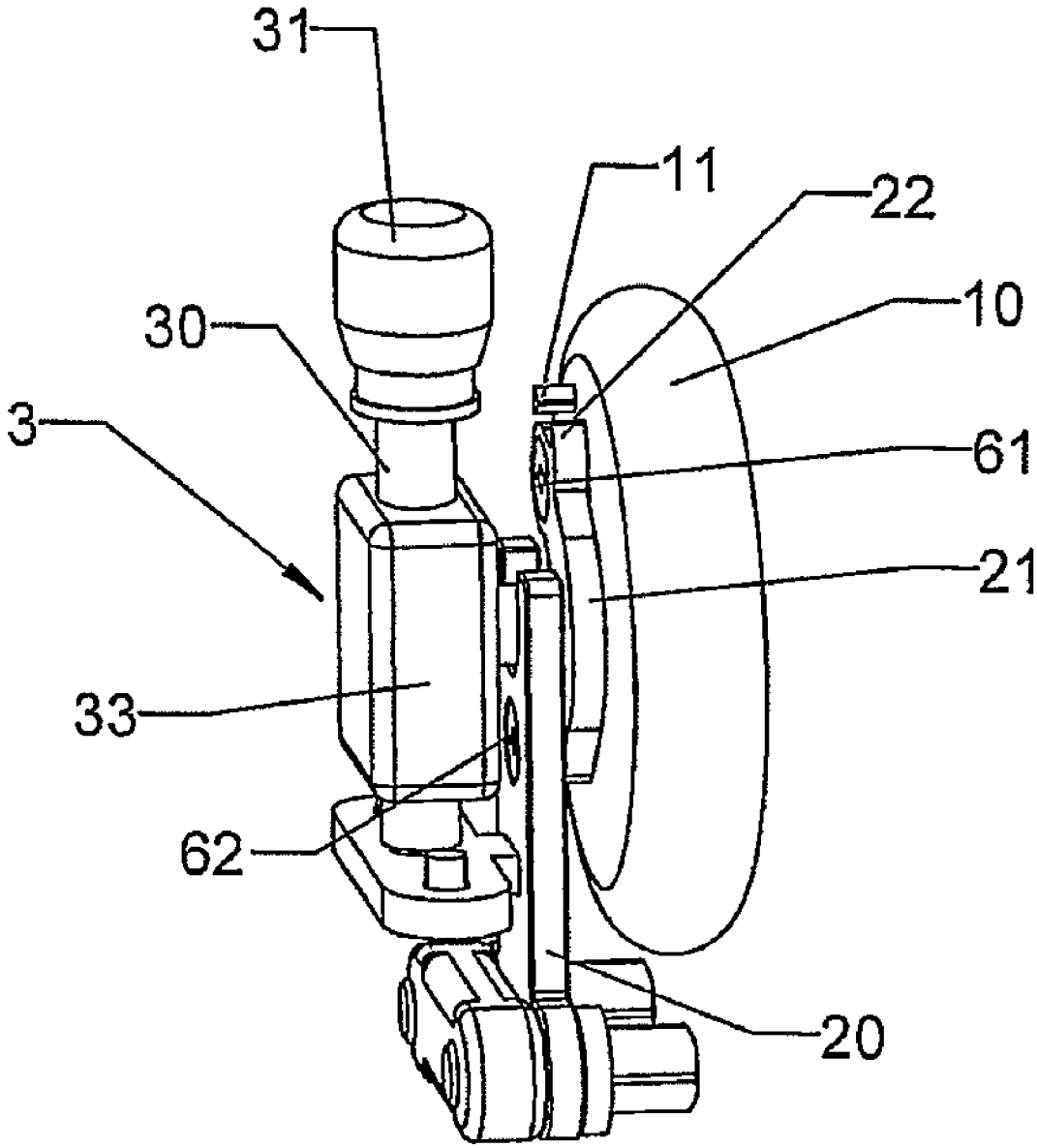

FIG. 2 shows a perspective view of the snare tension device 100 without the snare tension housing 4 in an assembled state. As it is evident from FIG. 2, the distance between the rotation element 10 and the pushing element 20 is selected so that a rotation movement of the transfer element 21 can occur. The transfer element 21 comprises a first connection section 61, which is connected with the rotation element 10, and a second connection section 62, which is connected with the pushing element 20. The distance between the pushing element 20 and the adjustment device 3 is selected so that a movement of the adjustment body 33 is not hindered.

Figure 3:
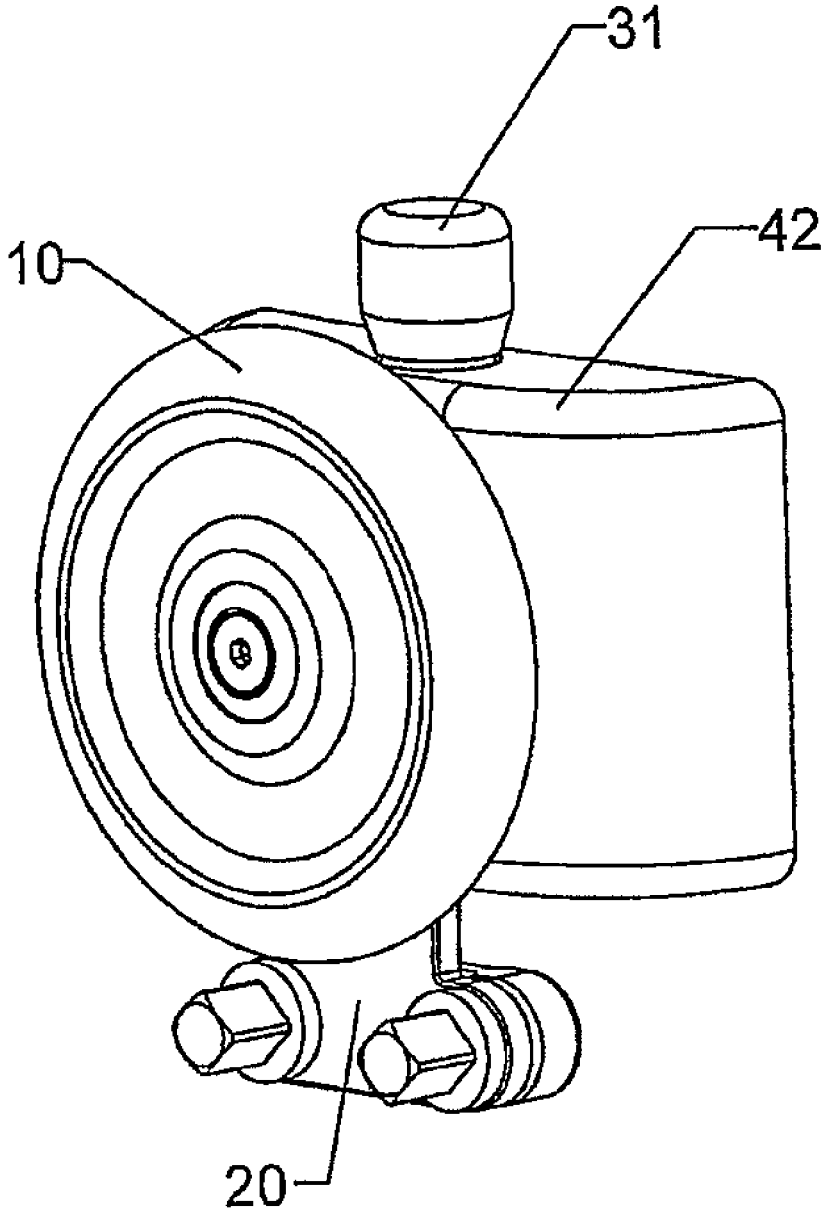

FIG. 3 shows the snare tension device in an assembled state from a perspective view, together with the snare tension housing 4. As it is evident from FIG. 3, the adjustment device 3 is accommodated in the snare tension housing 4 so that the adjustment means 31 projects from the housing 42 via the aperture 41. The housing 42 is connected with a snare not shown in FIG. 3.

Figure 4:
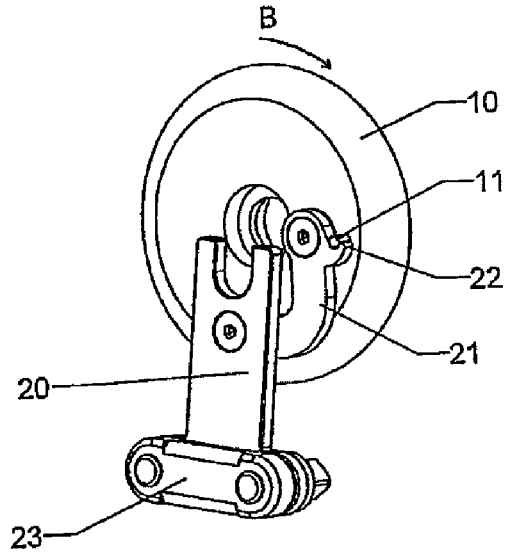

FIG. 4 shows a perspective view of the snare tension device without a snare tension housing and without an adjustment device in a state in which no tension is exerted on the snare wire not shown in FIG. 4.

In the situation shown in FIG. 4 the rotation element 10 is rotated in such a position so that the transfer element 21 places the pushing element 20 in a position in which the fixing device 23 does not exert tension to the snare wire. In such position of a rotation element 10 the pin 11 arranged on the rotation element 10 abuts against the projection 22 of the transfer element 21. A further rotation of the rotation element 10 in a rotation direction B is prevented by the abutment of the pin 11 against the projection 22.

Figure 5:
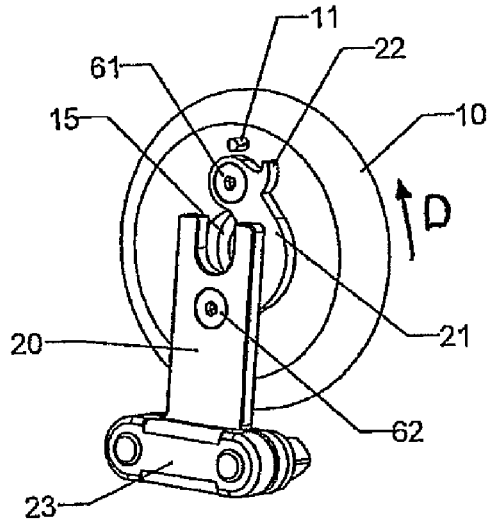

FIG. 5 shows a perspective view of the snare tension device without a snare tension housing and without an adjustment device in a state in which a tension is exerted on the snare wire.

Based on the position shown in FIG. 4, the rotation element 10 is rotated in the rotation direction D, which is opposite to the rotation direction B and does not cause an abutment of the pin 11 against the projection 22. The rotation of the rotation element 10 is transferred to the transfer element 21 and the pushing element 20 and, thus, to the fixing device 22 via the first and second connection sections 61, 62. The rotation movement of the rotation element 10 is transferred to a translatoric movement of the pushing element 20 via the transfer element 21. The pushing element 20 is moved in a direction towards the aperture 15 of the rotation element 10. The snare wire is tensioned by the translatoric movement of the pushing element 20 and, thus, of the fixing device 23 in the direction towards the aperture of the rotation element 10.

Figure 6:
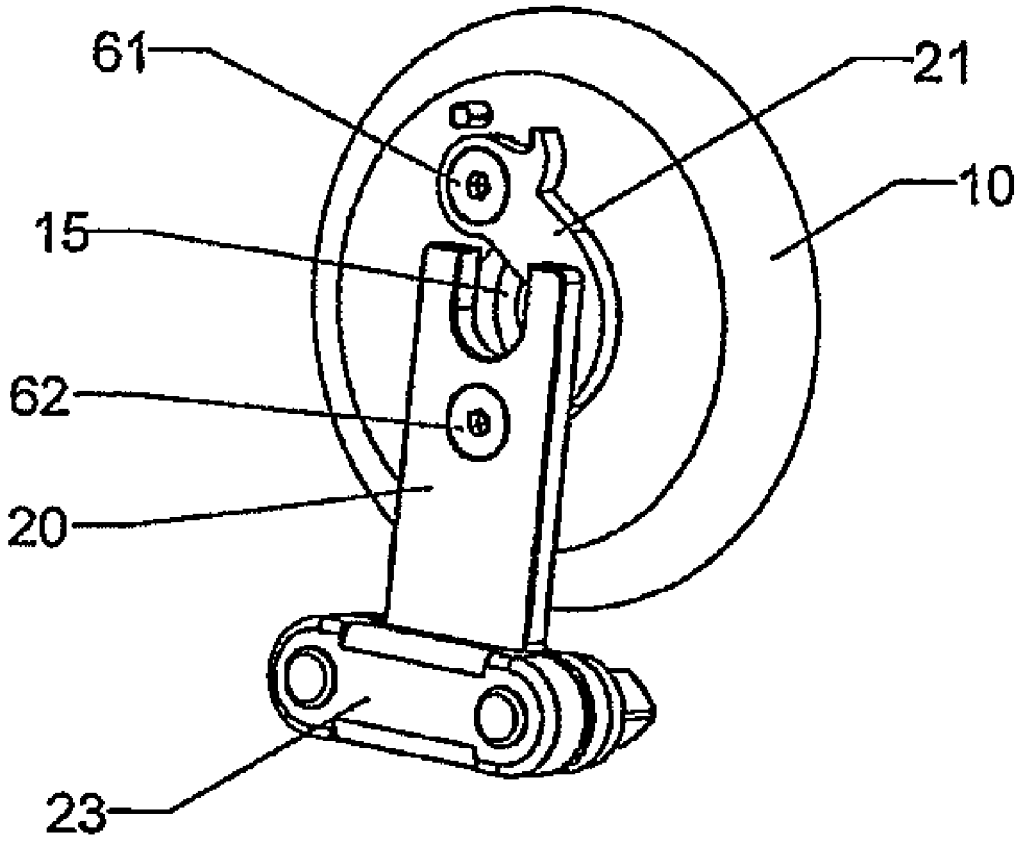

FIG. 6 shows a perspective view of the snare tension device without a snare tension housing and an adjustment device in a state in which a maximum tension is exerted on the snare wire and in which the snare tension device is in a locked state.

Based on the position shown in FIG. 5, the rotation element 10 is rotated further in the rotation direction D in order to reach the state according to FIG. 6. The transfer element 21 is also moved by the rotation of the rotation element 10. The transfer element 21 exerts such a force on the pushing element 20 via the second connection section 62 so that the pushing element 20 moves further in the direction towards the aperture 15 of the rotation element 10.

A kind of locking of the snare tension device 1 occurs at the position of the transfer element 21 shown in FIG. 6 so that an unintentional releasing of the snare wire by a revert rotation of the rotation element 10 in the rotation direction B can be prevented in an easy manner. Specifically, in the position of the transfer element 21 shown in FIG. 6 a tensile force is exerted on the rotation element 10 via the first connection section 61 by the snare wire not shown in FIG. 6. The tensile force causes a torque on the rotation element 10 in the rotation direction D which ensures the tensioning of the snare wire. Thus, an unintentional release can be prevented without providing an additional locking device. Based on the position of the rotation element 10 shown in FIG. 6, a further rotation of the rotation element 10 in the rotation direction D is prevented due to the abutment of the pushing element 20 against the bolt 14 arranged in the relief of the pushing element 20 so that FIG. 6 shows the position of the snare tension device in which the tension acting on the snare wire is maximum.

In the following, the tension process by means of the snare tension device is explained. Based on the state shown in FIG. 4, the rotation element 10 is rotated in the rotation direction D in order to tension the snare wire not shown. The rotation movement of the rotation element 10 is transferred to the pushing element 20 via the transfer element 21. As the transfer element 21 is formed as a curved eccentric lever and is connected with the rotation element 10 and the pushing element 20, the rotation movement of the rotation element 10 is transferred to a translatoric movement of the pushing element 20. The rotation element 10 can be rotated until the relief of the pushing element 20 abuts against the bolt 14.

A releasing of the snare wire occurs by rotating the adjustment means 32 in the rotation element 10 in the rotation direction B which is opposite to the rotation direction D for tensioning the snare wire. The rotation element 10 can be rotated only to the position shown in FIG. 4 for releasing the snare wire. In said position the pin 11 abuts against the projection 22 arranged on the transfer element 21 whereby a further rotation of the rotation element 10 is prevented.

A fine adjustment of the tension acting on the snare wire can be achieved by the adjustment means 31 for the adjustment body 33, which is adapted to be moved up or down along the adjustment shaft 30 by rotating the adjustment means 31. If a greater tension of the snare wire is demanded, the adjustment means 31 is rotated in the direction in which the adjustment body 33 shown in FIG. 1 is moved upwards. For the case that the tension acting on the snare wire shall be reduced, the adjustment means 31 is rotated in the opposite direction whereby the adjustment body 33 is moved downwards. A fine adjustment of the tension acting on the snare wire can occur based on different positions of the rotation element 10.

A fine adjustment can occur based on the position of the rotation element 10 shown in FIG. 4 in which no tension is exerted on the snare wire. For this purpose the adjustment means 31 is kept rotating in a direction until the adjustment body 33 is brought in the desired position. Afterwards, the rotation element 10 is rotated until the pushing element 20 abuts against the bolt 14 connected with the adjustment body 33 whereby the maximum tension acting on the snare wire is defined. Thus, the tension acting on the snare wire can be set dependent on the position of the adjustment body 33.

Based on the position of the rotation element 10 shown in FIG. 6 in which a tension has already been exerted on the snare wire, a fine adjustment of the tension acting on the snare wire can occur alternatively/additionally to the fine adjustment mentioned before. If a greater tensioning of the snare wire is demanded, the adjustment means 31 is rotated so that the adjustment body 33 and the rotation element 10 are moved upwards. As the rotation element 10 is connected with the transfer element 21, the transfer element is moved in the same direction as the rotation element 10. Additionally, the pushing element 20 connected with the transfer element 21 is also moved in the same direction as the rotation element 10 which finally causes an additional tension on the snare wire.

The adjustment means 31 is rotated in the opposite direction so that the adjustment body 33 is moved downwards in order to reduce the tension acting on the snare wire. In this case the bolt connected with the adjustment body 33 presses against the pushing element 20 and also moves the pushing element 20 downwards which results in reducing the tension acting on the snare wire.

The invention claimed is:

1. A snare tension device comprising: a rotation unit and a transfer unit, wherein the transfer unit includes a pushing element for tensioning or releasing a snare wire, and a separate transfer element that is connected with the rotation unit and the pushing element, wherein the separate transfer element transfers a rotational movement of the rotation unit into a longitudinal movement of the pushing element.

2. The snare tension device according to claim 1, wherein in a tensioned state of the snare wire, the rotation unit is rotated into a position in which a tensile force, which acts on the rotation unit by the snare wire, generates a torque that acts on the rotation unit in the same direction as a rotational direction of the rotation unit, which causes a tensioning of the snare wire.

3. The snare tension device according to claim 1, the rotation unit is a body with an axis of rotation and a pin placed at a position away from the axis.

4. The snare tension device according to claim 3, wherein the transfer element includes a first end located near the pin and a projection at the first end against which the pin is abuttable.

5. The snare tension device according to claim 1, further comprising a bolt, wherein the rotation unit includes a body with an axis, an axial aperture at its center and a ball bearing disposed within the aperture and the ball bearing positioned between the body and the bolt.

6. The snare tension device according to claim 5, wherein the transfer element is a curved eccentric lever partly surrounding the bolt.

7. The snare tension device according to claim 6, further comprising an adjustment device, and the bolt is fixedly connected to the adjustment device.

8. The snare tension device according to claim 7, wherein the adjustment device includes an adjustment mechanism, an adjustment body and an adjustment shaft and the adjustment body is moveable relative to the adjustment shaft.

9. The snare tension device according to claim 8, wherein the rotational movement of the adjustment mechanism is transferred to the adjustment shaft.

10. The snare tension device according to claim 9, the adjustment device is arranged in a snare tension housing.

11. The snare tension device according to claim 5, wherein the rotation element is a rotating wheel.

12. The snare tension device according to claim 7, wherein the adjustment device is arranged in a snare tension housing.

13. The snare tension device according to claim 8, wherein the adjustment device is arranged in a snare tension housing.

14. The snare tension device according to claim 2, wherein the rotation unit is a body with an axis of rotation and a pin placed at a position away from the axis.

15. The snare tension device according to claim 5, further comprising an adjustment device and the bolt is fixedly connected with the adjustment device.

16. The snare tension device according to claim 15, wherein the adjustment device includes an adjustment mechanism, an adjustment body and an adjustment shaft, and the adjustment body is moveable relative to the adjustment shaft.

17. A snare tension device comprising:

a rotation wheel;

a transfer unit having a mechanical element mechanically coupled to the rotation wheel and a pushing element for tensioning or releasing of a snare wire; and a separate transfer element connected with the rotation unit and the pushing element, to transfer a rotational movement of the rotation unit into a longitudinal movement of the pushing element.

18. The snare tension device according to claim 17, wherein the wheel comprises a pin placed at a position away from the axis of the wheel.

19. The snare tension device according to claim 18, wherein the transfer element includes a first end located near the pin and a projection at the first end and the pin abuts against the transfer element projection.

20. The snare tension device according to claim 17, further comprising a bolt and a ball bearing, wherein the bail hearing is disposed within the rotation wheel between the rotation element and the bolt.

* * * * *